US006616710B1

(12) United States Patent
Costin et al.

(10) Patent No.: US 6,616,710 B1
(45) Date of Patent: Sep. 9, 2003

(54) LASER SCRIBING PROCESS TO ELIMINATE THE DENIM ENZYME BY WASHING AND LAUNDRY

(75) Inventors: Darryl Costin, Westlake Village, OH (US); Heath Colwell, Cleveland, OH (US)

(73) Assignee: Technolines LLC, Perrysburgh, OH (US)

( * ) Notice: Subject to any disclaimer, the term of this patent is extended or adjusted under 35 U.S.C. 154(b) by 0 days.

(21) Appl. No.: 09/755,531

(22) Filed: Jan. 5, 2001

Related U.S. Application Data

(63) Continuation of application No. 09/408,136, filed on Sep. 29, 1999, now abandoned.
(60) Provisional application No. 60/102,525, filed on Sep. 30, 1998.

(51) Int. Cl.[7] ..... D06P 5/20; D06Q 1/02; D06M 10/00

(52) U.S. Cl. ..... 8/444; 8/114.6; 8/115.52; 8/137; 8/150; 8/159; 8/151

(58) Field of Search ..... 8/444, 114, 114.6, 8/137, 150, 159; 219/121.68, 121.69; 427/554

(56) References Cited

U.S. PATENT DOCUMENTS

| | | | | |
|---|---|---|---|---|
| 4,575,887 | A | * | 3/1986 | Viramontes |
| 5,122,159 | A | * | 6/1992 | Olson et al. |
| 5,567,207 | A | | 10/1996 | Lockman et al. |
| 5,916,461 | A | | 6/1999 | Costin et al. |
| 5,990,444 | A | | 11/1999 | Costin |

FOREIGN PATENT DOCUMENTS

| | | |
|---|---|---|
| JP | 3-455578 | 2/1991 |
| JP | 5-138374 | 6/1993 |

* cited by examiner

*Primary Examiner*—Margaret Einsmann
(74) *Attorney, Agent, or Firm*—Scott C. Harris, Esq.

(57) ABSTRACT

A system of forming simulated seam abrasion on denim materials. The simulated seam abrasion is formed by using a laser beam to form a seam abrasion type pattern on the material. The pattem is like a ladder with uneven rungs. After the pattern is formed, the material is washed to better simulate real seam abrasion.

8 Claims, 4 Drawing Sheets

LASER SCRIBING PROCESS TO ELIMINATE THE DENIM ENZYME BY WASHING AND LAUNDRY

The present application claims priority from provisional application No. 60/102,525, filed Sep. 30, 1998 and is a continuation of application Ser. No. 09/408,136, filed Sep. 29, 1999 now abandoned.

BACKGROUND

The present invention relates to producing a look and feel of prewashed denim using a simplified process and technique.

The current system of producing "prewashed" denim materials, e.g., denim jeans, washes the jeans in a chemical environment that simulates a number of washings.

Denim jeans are typically washed 100 pairs at a time in a 500 pound plus washing machine. The washing is typically carried out for two hours, with specific concentrations of desizing agents, enzymes and softening agents.

The purposes of the wash include: 1) Remove the waxy "sizing" from the denim, 2) Remove part of the indigo dye, 3) Soften the rigid denim, 4) Produce a stonewashed type look and 5) Provide the unique seam abrasion (worn "ladder type" look) on all the seams on the jeans.

Stones can be used to replace some or all of the enzymes for purposes of removing some of the color in the denim during the wash process and to provide the seam abrasion. In some cases the wash water has to be drained and filled three times. It is not unusual to use 35 gallons of water per pair of jeans washed.

The enzyme washing process has numerous drawbacks. It is reported that the true total cost for enzyme washing one pair of denim jeans is about $3 per pair when all unit cost and freight parameters are considered. The enzyme washing process also significanty reduces, by, for example, as much as 36%, the tensile and tear properties of the denim. The enzyme washing process also produces numerous defects such as back pocket blowout that results in scrap or rework. Also, as described above, the enzyme washing process uses as much as 35 gallons of water per pair of jeans. There are also other significant environmental problems associated with the handling and disposal of the enzymes and waste water.

U.S. Pat. No. 5,567,207, assigned to Icon, Inc, disclosed a water free method for color fading textile materials with the use of a laser. The patent specifically indicated that the wavelength of the laser should be chosen such that it is strongly absorbed by the dye, but not by the textile material. Icon used a Yag Laser for this purpose with a wavelength of 1,064 nanometers.

Accordingly, the Icon patent taught that the Yag laser process will provide optimum dye photo-decomposition, and also specifically that the material should not be damaged by the laser exposure. The Icon patent did not teach a specific method to laser-scribe a pair of denim jeans to achieve the specific color, cast and character that is obtained from an enzyme or stone wash.

In contrast, previous applications by the assignee of the present invention have described laser scribing rigid denim by intentionally damaging the material. This is done by scanning the laser across the denim. However, previous attempts, while they may do an effective job of removing the indigo dye, simply cannot replicate the unique cast and character of denim obtained from enzyme or stonewashing. Our previous applications have described using a CO2 laser with a wavelength an order of magnitude higher than the Yag laser in order to remove the dye and alter the surface chemistry. Also, only specific and unique laser processes must be used other than the conventional scanning the laser across the denim material in an edge-to-edge or dot-to-dot method. The wavelength of the. CO2 laser is 10,600 nanometers. This characteristic does alter the surface chemistry)of the fabric upon lazing, such that the fabric is indeed damaged, albeit at an acceptable level.

For example, TechnoLines, Inc. has determined that the percent reduction in warp tensile strength from a CO2 lazing process which replicates the unique pattern and look of stonewashed or enzyme washed denim is about 10%. This is, however, acceptable, given that the conventional enzyme washing process reduces warp tensile properties by about 36%. Therefore, the TechnoLines, Inc. laser scribing process alters the surface chemistry and removes the indigo dye and clearly but acceptably damages the textile material and produces the denim enzyme washed look as disclosedin this specification.

SUMMARY

The inventors recognized a critical need to develop a process to reduce the exposure of the denim to the harmful enzymes and thus reduce the water and chemical requirements associated with the enzyme washing process. The inventors also recognized a critical need to develop a process to eliminate the laundry process as it exists today and achieve product performance, manufacturing cost, environmental and turnaround time benefits.

The present disclosure teaches some form of washing must be used to eliminate the residue on the denim sheet after laser scribing. One such process disclosed by this disclosure is an on-line washing process where the denim ribbon is lazed and then passed through feed rollers and a bath to wash and rinse the residue, including the sizing material from the denim material. While washing is still necessary, that washing is much shorter than previously necessary, and also can be done on line as part of the manufacturing process.

Another irmportant issue is seam abrasion. The Icon patent does not teach any methodology to provide the unique seam abrasion on denim which is obtained from the enzyme washing process. In order to eliminate the enzyme washing process, a new technology is disclosed that provides the worn "ladder type" look along the seams that is obtained from the enzyme washing process. The present disclosure describes two techniques to provide seam abrasion without the use of the enzyme washing—a first using rocks in the washer without enzymes, and a second using lasers.

Best results are obtained by lasing while staying within a specific EDPUT range (energy density per unit time).

BRIEF DESCRIPTION OF THE DRAWINGS

These and other aspects will be described with referenece to the drawings, in which.

DESCRIPTION OF THE EMBODIMENTS

One aspect of the present disclosure is based on the inventors' realization that the best possible replication of the enzyme or stone washed look on denim includes two parts: 1) First the specific cast and character of the denim provided by the enzyme wash process must be obtained and 2). The seam abrasion provided by the enzyme wash process must be obtained. According to an aspect described herein, both 1) and 2) are carried out using a non-enzyme wash technique. This non-enzyme wash technique can use detergent or desizing agent, but does not use enzymes.

In the first process, the entire surface of the denim must be scribed in one of two unique ways described below.

Figure 1:
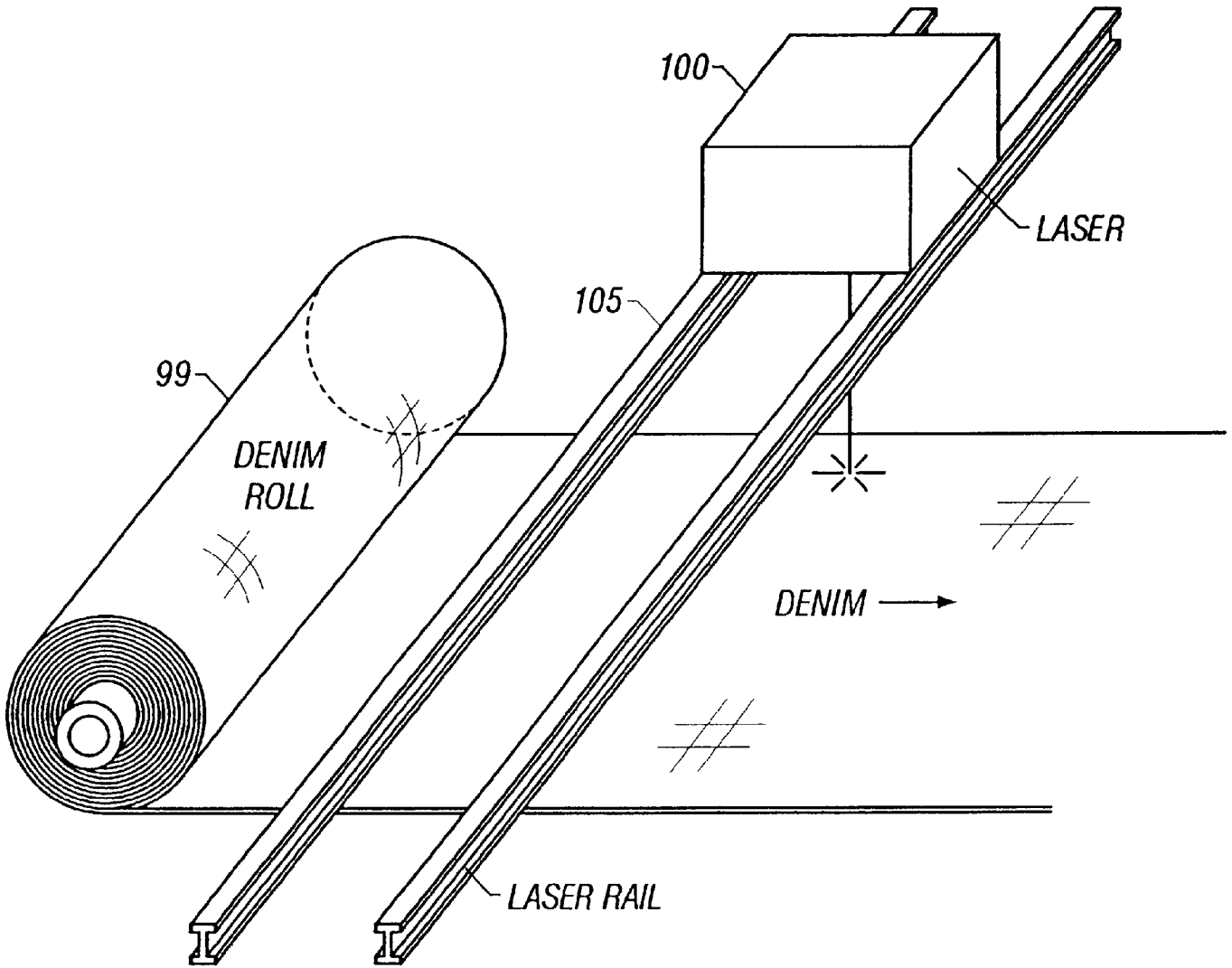
FIG. 1 shows processing a denim material using a roll.
Figure 2:
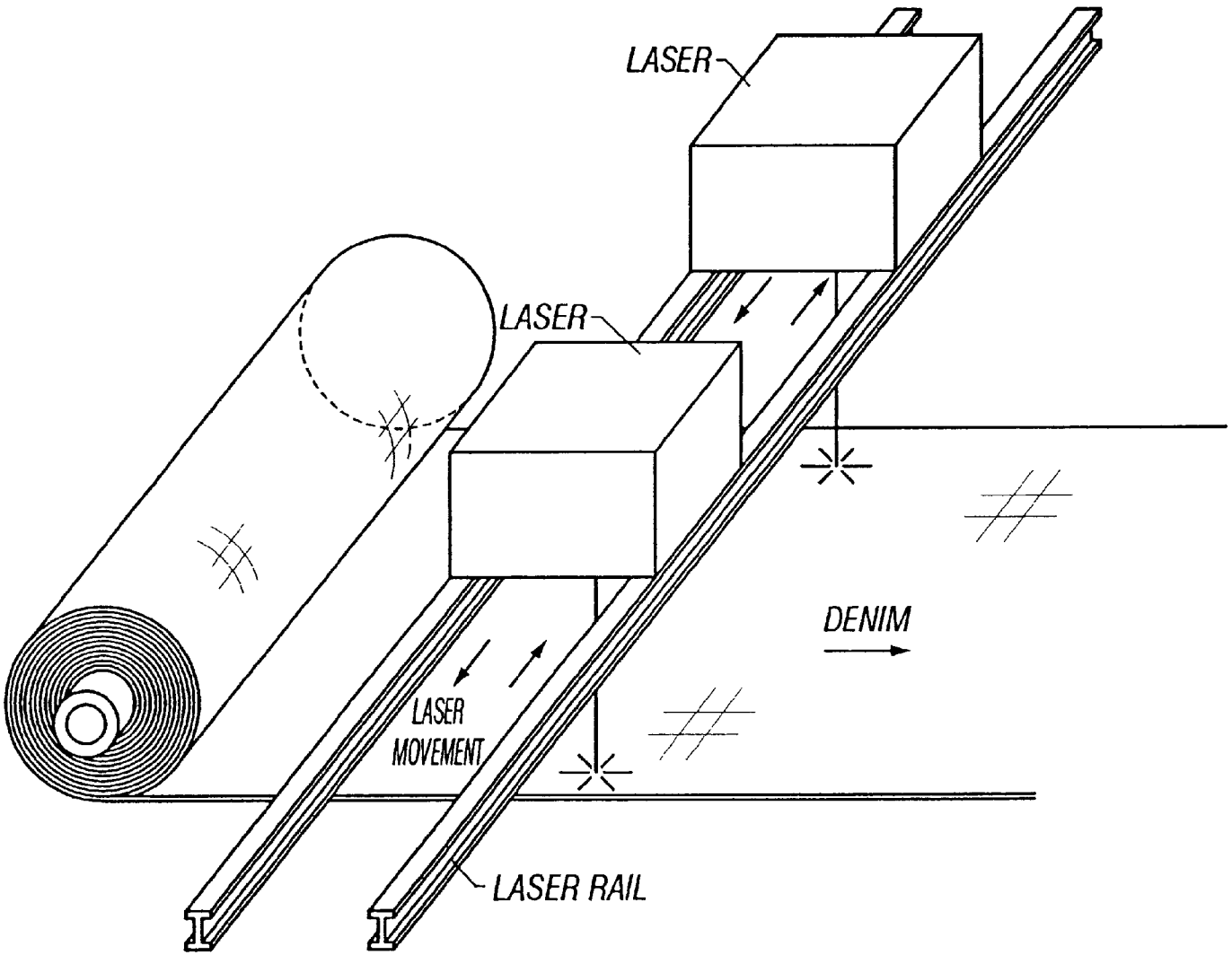
FIG. 2 shows using two lasers along a length of the material.
Figure 3:
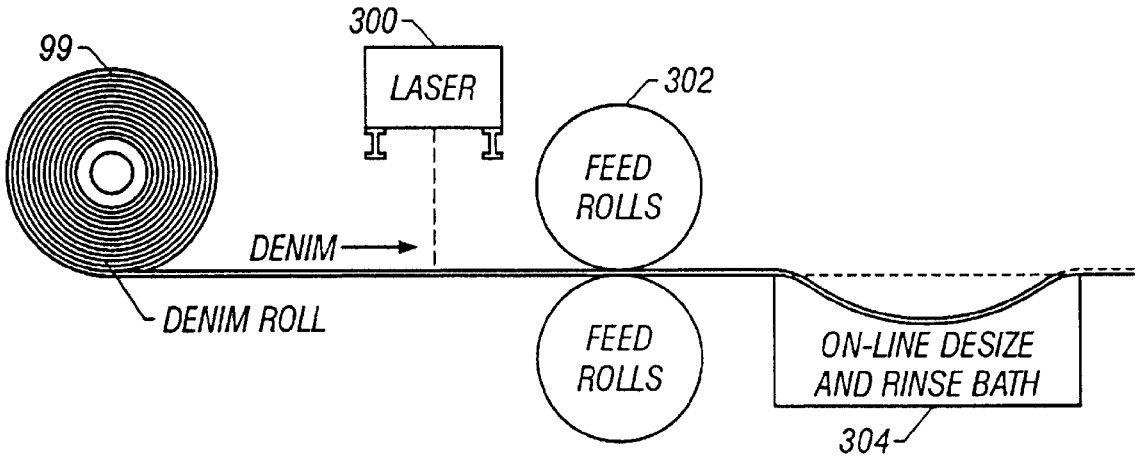
FIG. 3 shows a denim roll conveyer using feed rolls.

FIGS. 1–3 show two processes for using the laser scribing process in the textile mill and at the cutting table in the denim sewing plants.

A first embodiment is described with reference to FIGS. 1–2. A laser 100 is mounted on a rail 105 along the width of the denim ribbon 99. The laser is controlled according to the teachings of U.S. Pat. No. 5,990,444 to scribe a desired pattern on the denim ribbon 99. This is done by traversing a path along the width of the denim ribbon 99 and repeating this operation In a continuous fashion.

One or multiple lasers can be mounted on the rails to allow for partitioning the width of the ribbon, so that each laser scribes a specific section of the width.

FIG. 2 shows an alternative embodiment where multiple lasers are used, and the scribing movement is via the galvometric mirrors in the laser.

FIG. 3 shows a laser scribed product line. Denim is fed from a roll 99 past a laser 300, and through feed rolls 302. The denim roll is passed through in an on line bath 304. which can include a mild desizing agent. This can be done right on line thereby significantly reducing the manufacturing costs associated with the washing of denim.

Figure 4:
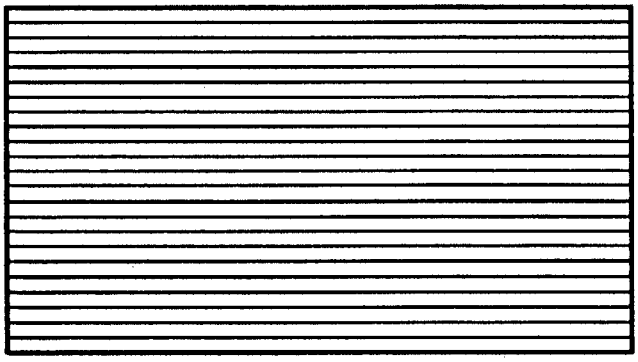
FIGS. 4 and 5 the pattern of scribing lines on a denim material.

Special laser-scribing methodologies are used to replicate the denim cast, color and character obtained from a conventional enzyme or stone wash. A laser is used to scribe a pattern of finely-spaced lines as shown in FIG. 4. The scribing is done at a specific energy density per unit time ("EDPUT") as described in U.S. Pat. No. 5,990,444. After the denim is washed in a conventional washing machine with typical laundry detergent, the denim does have the color property of denim which has been enzyme or stone washed. Unfortunately, the denim does not have the cast or character obtained from the enzyme or stone wash.

Figure 5:
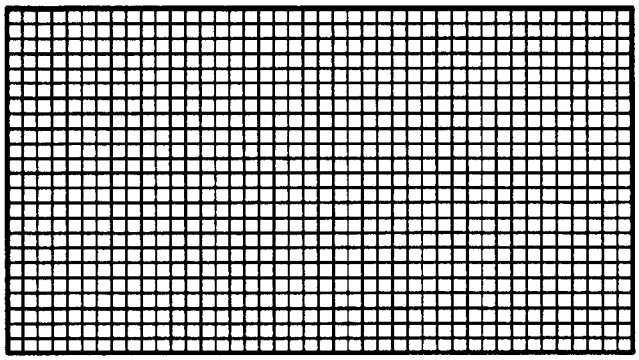

FIGS. 4 and 5 show an improved pattern formed to make a better product. A laser is used to scribe a pattern of finely spaced lines across the denim sheet and at an EDPUT level about half of the EDPUT for the single pass. The scribing is then repeated at a 90 degree orientation relative to the first pass, to form a graph like pattem.

The resulting denim, after washing in a home washing machine with standard detergent, almost perfectly replicates the color, cast and character of denim that has been enzyme or stone washed.

This embodiment uses a line spacing which is typically preferably between 0.05 and 0.2 inch and a double pass laser scribing process operating in opposite directions.

Figure 6:
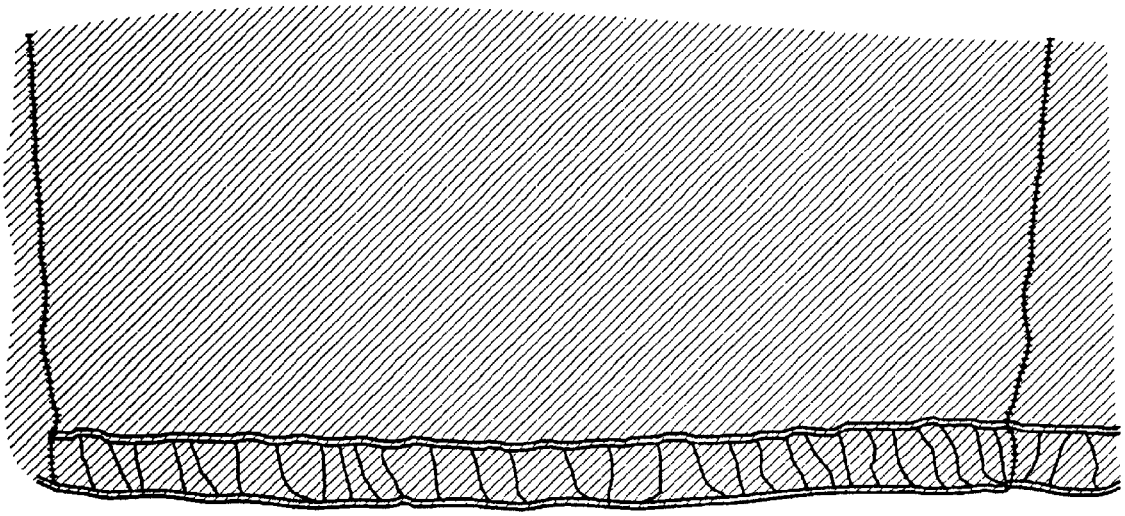
FIG. 6 shows a pattern of seam abrasion formed by a laser etching.

FIG. 6 shows the seam abrasion caused by the standard enzyme wash as now used in conventional processes. The inset shows a detail of the seam abrasion —the parts look like a randomly distorted ladder, with certain rungs aligned, others unaligned.

This operation does in fact give the required cast and character properties to the denim following home washing. The EDPUT level for each pass is reduced from the single pass, the speed of the laser scribe can be twice as fast. Accordingly, the total cycle time for the dual pass process can be the same as the single pass process. The laser operating settings and EDPUT for this dual process are shown in Table I.

The second unique laser scribing methodology that produced denim that had the same appearance with respect to cast, character and color of enzyme washed or stone washed denim was the use of TechnoLines, LLC TechnoBlast process described in U.S. Pat. No. 5,916,461. This patent teaches the use of a software program that simulates sandblasting so as to control the degree of feathering in laser scribing the denim. TechnoBlast requires the user to enter the probability distributions governing the probability that the laser will strike each pixel on the pattern. The inventors realized that if the pattern has a random laser striking probability of 80 to 110% for each pixel, that the resulting look after home washing will in fact replicate the cast and character and color of enzyme or stonewashed denim.

The laser operating settings and EDPUT for the second embodiment of the TechnoBlast process is shown in Table II.

Both of these systems allow simulating the proper look of the denim without the conventional enzyme washing. However, neither provides the proper amount of seam abrasion, such as would be provided from enzyme washing. Two additional processes are described herein to simulate the seam abrasion without the use of enzyme washing.

In the first process, the lazed denim is washed in a conventional washing machine with the addition of typical stones. TechnoLines has found that after a short 10–15 minute rinse, the denim has both the cast and character and the seam abrasion obtained from enzyme washing. The advantages of this process include the elimination of the enzyme chemicals and subsequent improvement in denim physical properties and yield as well as a major reduction in water and cycle time.

The second seam abrasion simulating process that TechnoUnes has developed to provide the seam abrasion obtained from enzyme washing uses a laser to scribe the particular "ladder type" pattern, shown and explained above with reference to FIG. 6, on the seams of denim jeans. Following washing in a conventional washing machine with home laundry detergent, the seams appear abraded just like they were enzyme washed.

A most preferable process on the seams is carried out in the textile mills such that the on-line rinsing process described above is used to obtain the seam abraded look provided by enzyme washing. The enzyme washing process gives a unique cast and character to denim.

Denim mills can provide different looks from the basic denim manufacturing process. It is believed that the denim mills may even be able to provide a more abraded or worn look. However, even if this is the case, the denim must still be enzyme washed to obtain the seam abrasion. However, with TechnoLines new development to achieve seam abrasion with the laser, the denim would not have to be enzyme washed to achieve the desired look. TechnoLines was able to replicate the seam abrasion look by using painting the "ladder" type image on the screen using the TechnoBlast program which produces a specified degree of feathering along the ladder rungs. Alternately, TechnoLines scanned in the image of the seam abrasion as shown in FIG. 6 and used TechnoEtch to transfer the scanned image to vector format for subsequent lazing.

The benefits of using one of the unique laser methods invented by TechnoLines to eliminate enzyme washing are numerous and include:

1. Eliminate the use of enzymes and associated environmental problems,
2. Significant reduction of use of water in the laundry process.
3. Reduced use of electricity in the laundry process.
4. Reduce laundry cycle time.
5. Reduce damage to garments.
6. Improve product physicals such as tensile strength.
7. Reduce rejects and rework.

Other embodiments are contemplated.

TABLE I

Laser Operating Variables and EDPUT for TechnoLines Dual Pass Laser Process Which Replicates the Look or Enzyme Washed Denim

| | |
|---|---|
| Power (Watts) | 50 |
| Area of Spot (mm2) | .035 |
| Marking Speed (mm/sec) | 610 |
| Marking Field (mm) | 203 |
| Wavelength (nanometers) | 10,600 |
| Distance from the Lens to the Denim (mm) | 381 |
| EDPUT (watts-sec/mm3) | 2.35 |

TABLE II

Laser Operating Variables and EDPUT for TechnoLines TechnoBlast Laser Process Which Replicates the Look or Enzyme Washed Denim

| | |
|---|---|
| Power (Watts) | 50 |
| Area of Spot (mm2) | .035 |
| Marking Speed (mm/sec) | 635 |
| Marking Field (mm) | 203 |
| Wavelength (nanometers) | 10,600 |
| Distance from the Lens to the Denim (mm) | 1084 |
| EDPUT (watts-Sec/mm3) | 2.25 |

What is claimed is:

1. A method of processing a textile material, cornprising:

placing a material on a conveyer which passes a plurality of processing stations;

at one of said processing stations, using a laser to scribe a plurality of lines on said material at a specific energy density per unit time; and at another of said stations along said conveyer, that is passed after said one processing station, washing said material.

2. A method as in claim 1 wherein said using a laser comprises scribing lines on the material twice using a specified energy density optimized for scribing twice.

3. A method as In claim 2 wherein said scribing includes a first scribing pass forming lines at a first direction, and second scribing pass forming lines in a second direction different than said first direction.

4. A method as in claim 3 wherein said directions are 90 degrees oriented relative to one another.

5. A method as in claim 1 wherein said lines are between 0.05 and 0.2 inches apart.

6. A method of processing a denim material, comprising:

determining a desired energy density per unit time to use in a laser for scribing the denim material;

using substantially half the determined energy density per unit time for a first pass, and then using the same half the energy density per unit time for another pass.

7. A method as in claim 6 wherein said first pass and said another pass are in different directions.

8. A method as in claim 7 where said first pass and said another pass are in substantially orthogonal directions.

* * * * *